United States Patent [19]

Pundt

[11] 4,295,298

[45] Oct. 20, 1981

[54] WINDOW REGULATOR

[76] Inventor: Richard A. Pundt, 4118 Hickory Hill La. SE., Cedar Rapids, Iowa 52403

[21] Appl. No.: 70,178

[22] Filed: Aug. 27, 1979

[51] Int. Cl.[3] ..... E05F 11/14

[52] U.S. Cl. ..... 49/353; 296/146

[58] Field of Search ..... 49/353, 348, 351, 363; 296/146, 155

[56] References Cited

U.S. PATENT DOCUMENTS

| | | | |
|---|---|---|---|
| 2,301,696 | 11/1942 | Grab | 49/353 |
| 3,186,203 | 6/1965 | Stapp | 49/353 X |
| 3,389,500 | 6/1968 | Schonberger | 49/351 |
| 4,034,509 | 7/1977 | De Rees | 49/353 |
| 4,151,683 | 5/1979 | Narita et al. | 49/353 X |

FOREIGN PATENT DOCUMENTS

| | | | |
|---|---|---|---|
| 663056 | 3/1931 | France | 49/353 |
| 13312 | 12/1905 | United Kingdom | 49/353 |

*Primary Examiner*—Joseph F. Peters, Jr.
*Assistant Examiner*—Norman L. Stack, Jr.

[57] ABSTRACT

A window regulator for moving a window pane through the window opening of a vehicle door includes a single eccentric arm pivotally mounted away from its ends within the door. One end of the eccentric arm is movably secured to a guide bar on the window pane and the opposite end has a handle thereon which is movable within and accessible through an arcuate slot in the vehicle door. The handle is recessed within the arcuate slot so as not to protrude from the interior surface of the door.

3 Claims, 5 Drawing Figures

WINDOW REGULATOR

BACKGROUND OF THE INVENTION

The present invention is directed generally to window mechanisms and more particularly to an improved window regulator for an automobile type window.

Automobile window regulators generally comprise a cumbersome and somewhat complicated system of gears and linkages, all for the purpose of raising and lowering the automobile window pane. Such mechanisms are expensive to manufacture, and contribute unnecessarily to the weight and required thickness for the automobile door. Furthermore, presently known window regulators are generally operated by some sort of handle which protrudes interiorly of the door surface thereby presenting a safety hazard which may cause injury in the event of an accident. Finally, the rotary cranks associated with most window mechanisms are difficult to operate for many people.

Accordingly, a primary object of the invention is to provide an improved window regulator.

Another object is to provide a lightweight window regulator which requires only a minimum door thickness to accommodate the same.

Another object is to provide a window regulator which includes only a minimum number of parts and is adapted to be manufactured most economically.

Another object is to provide a window regulator which is easy to operate.

Another object is to provide a window regulator wherein the operating portions thereof are recessed into the vehicle door for safety.

Another object is to provide a window regulator which is compatible with modern automotive design.

Finally, an object is to provide a window regulator which is simple in construction and durable and efficient in operation.

SUMMARY OF THE INVENTION

The window regulator of the present invention is adapted for a vehicle door having a window pane recessed in and movable through the window opening of the door. The regulator includes a single eccentric arm which is mounted on the vehicle door for pivotal movement about an axis positioned in spaced relation from both ends of the arm. One end of the arm is movably secured to a guide bar on the window pane and the other end has a handle thereon which is movable within an arcuate slot in the vehicle door. The handle is recessed within the slot so that no dangerous projections are exposed to the vehicle passengers. By simply reciprocating the handle within the arcuate slot, the vehicle window is opened and closed.

DESCRIPTION OF THE PREFERRED EMBODIMENT

Figure 1:
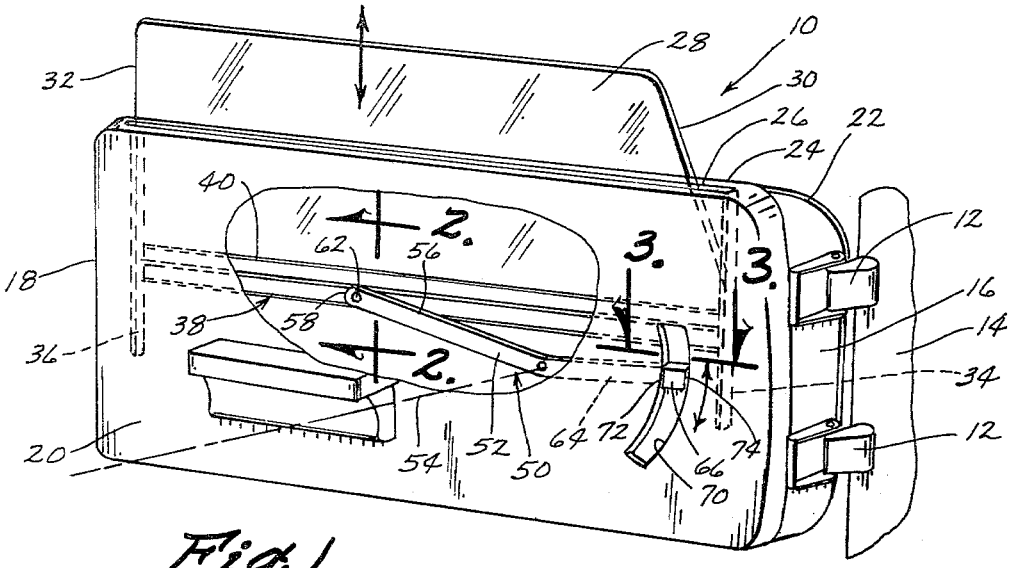
FIG. 1 is a partially fragmented perspective view of a vehicle mounted door with a portion broken away to expose the window regulator therein.
Figure 2:
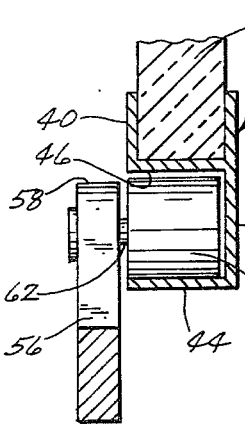
FIG. 2 is an enlarged detail foreshortened sectional view showing the connection of the eccentric arm to the window pane guide bar as seen on line 2—2 in FIG. 1.

Referring to FIG. 1, there is shown a vehicle door 10 pivotally secured by hinges 12 onto the chassis 14 of an automotive type vehicle. Door 10 has a forward end 16, rearward end 18, interior and exterior sides 20 and 22 respectively and a top surface 24. A window channel or opening 26 is formed in top surface 24 for movement of a window pane 28 generally vertically therethrough. Window pane 30 includes generally upright forward and rearward edges 30 and 32 which are vertically slidably received within slide tracks 34 and 36 respectively. The slide tracks are securely mounted within the vehicle door 10. Finally, the window pane 28 has an elongated guide bar 38 secured to and extended along the bottom edge thereof for a purpose to be described below. In FIG. 2, it is seen that guide bar 38 is somewhat y-shaped including an upwardly opening channel portion 40 which receives the window pane 28 and downwardly and interiorly extended flanges 42 and 44 respectively which define an interiorly opening channel 46.

The window regulator of the present invention, indicated generally at 50, includes an enlongated eccentric arm 52 which is mounted within the vehicle door 10 for pivotal movement about a transverse axis 54. The eccentric arm may be pivotally supported on a pin secured directly to the interior side 20 of the door or a suitable bracket may be provided for positioning the window regulator somewhat exteriorly of side wall 20.

Figure 3:
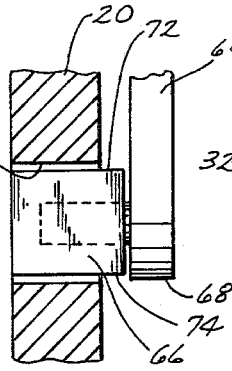
FIG. 3 is an enlarged top partially sectional detail view of the connection of the eccentric arm to the handle as seen on line 3—3 in FIG. 1.

Eccentric arm 52 includes a first arm portion 56 having the free end 58 secured for movement along the channel 46 of the window guide bar 38. Specifically, first arm portion 56 includes a roller 60 (FIG. 3) rotatably carried on the exterior side thereof on a shaft 62 for rolling engagement within the guide bar channel 46.

A second arm portion 64 has a handle 66 (FIGS. 1 and 3) pivotally secured at the free end 68 thereof for sliding engagement within an arcuate slot 70 formed in the interior side wall 20 of the vehicle door 10. Slot 70 is arranged concentric with pivot axis 54 and is positioned so as to be generally vertically disposed and horizontally spaced from the pivot axis. Handle 66 extends interiorly through slot 70 no further than the interior side 20 of the door so that no interior projections are presented.

Because the pivot axis 54 is only insubstantially offset from a line 73 interconnecting the opposite ends of the eccentric arm 52, those ends move in substantially opposite tangential directions when the eccentric arm 52 is pivotally moved. In the preferred embodiment shown, second arm portion 64 is offset from the center line of first arm portion 56 by no more than 45°.

Figure 4:
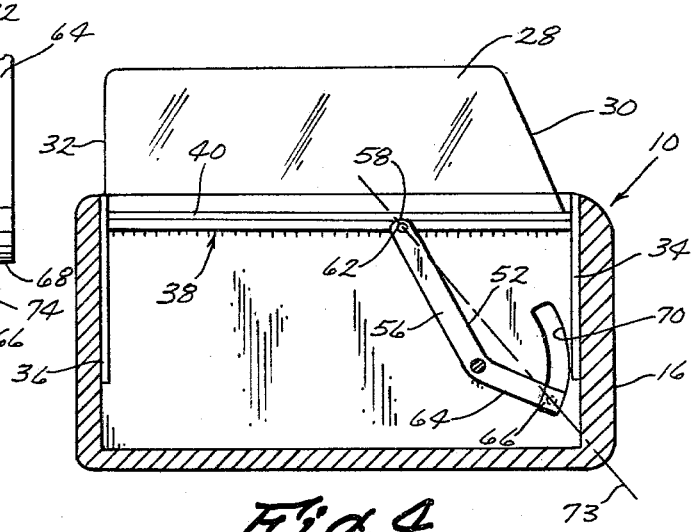
FIG. 4 is a partially sectional elevational view of a vehicle door showing the window regulator and window pane in a closed position.
Figure 5:
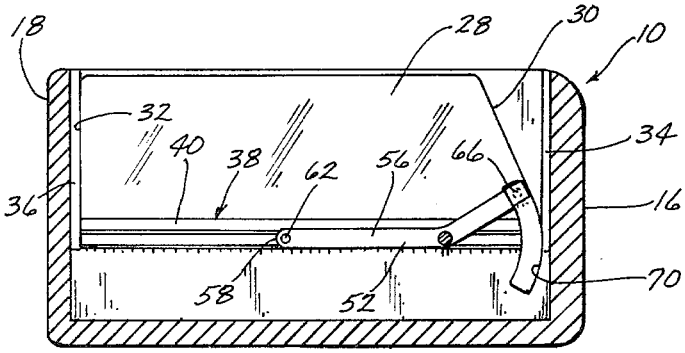
FIG. 5 is a partially sectional elevational view of a vehicle door showing the window regulator and window pane in an open position.

In operation, to move the window pane from the closed position of FIG. 4 to the open position of FIG. 5, an operator need only engage the handle 66 with his fingers to lift the handle 66 within the arcuate slot 70. Accordingly, the first arm 56 pulls the window pane 28 downwardly within the slide tracks 34 and 36 while roller 60 retracts rearwardly within the guide bar channels 46. To raise the window, handle 66 is simply pivoted downwardly within slot 70 back to the position in FIG. 4.

Note that although handle 66 is pivotally connected to second arm 64, it includes radially inwardly and outwardly facing surfaces 72 and 74 respectively which generally conform to the arcuate slot 70 for only circumferential sliding movement therealong.

Thus there has been shown and described a window regulator which includes only a minimum number of parts and may be most economically manufactured. The installed window regulator is easily operated and presents no interior projections which could otherwise cause injury in the event of an accident or the like. Accordingly, the window regulator described herein accomplishes at least all of the stated objects.

It is claimed:

1. A window regulator for vehicles comprising, a vehicle door having a window opening, an interior side and exterior side, a window pane recessed in said door, adapted to move through said window opening, and including two substantially vertically disposed edges, a guide bar on said window pane within said door, a single eccentric arm pivotally mounted away from its ends within said door with one end thereof being movably secured to said guide bar, and said pivot point being offset below a line extending between the opposite ends of said arm whereby the opposite ends of said arm move in substantially opposite directions, an arcuate slot in said door being substantially vertically disposed and positioned forward from and concentrically about said pivot point, a handle on the other end of said eccentric arm and being recessed within said arcuate slot and extending interiorally through said slot no further than the interior of said door, and means connected to said door between the sides thereof and adapted to slidably receive the edges of said window pane.

2. The window regulator of claim 1 wherein said handle is pivotally connected at the other end of said eccentric arm, said handle having radially inwardly and outwardly facing surfaces which generally conform to said arcuate slot for sliding movement therealong.

3. The window regulator of claim 2 wherein the opposite ends of said eccentric arm move in substantially opposite directions with respect to said pivot axis when the eccentric arm is pivoted thereabout.

* * * * *